United States Patent [19]

Antonious

[11] 4,451,995

[45] Jun. 5, 1984

[54] ADJUSTABLE AND FLEXIBLE CLOSURE ASSEMBLY FOR SHOES WITH ELASTICIZED LOWER VAMP OPENING

[76] Inventor: Anthony J. Antonious, 205 E. Joppa Rd., Towson, Md. 21204

[21] Appl. No.: 217,895

[22] Filed: Dec. 18, 1980

Related U.S. Application Data

[63] Continuation-in-part of Ser. No. 21,008, Mar. 16, 1979, abandoned.

[51] Int. Cl.[3] ..... A43B 11/00; A43B 23/26

[52] U.S. Cl. ..... 36/51; 36/54

[58] Field of Search ..... 36/50, 51, 52, 54, 114, 36/129; 24/204, 73 GC, 73 ES; 2/DIG. 6

[56] References Cited

U.S. PATENT DOCUMENTS

| | | | |
|---|---|---|---|
| 312,675 | 2/1885 | Turner | 36/51 |
| 793,095 | 6/1905 | Rapp | 36/54 |
| 1,028,598 | 6/1912 | Papp | 36/54 |
| 1,862,047 | 6/1932 | Boulet et al. | 36/51 X |
| 3,037,303 | 6/1962 | Steuer | 36/51 |

FOREIGN PATENT DOCUMENTS

| | | | |
|---|---|---|---|
| 730107 | 5/1932 | France | 36/51 |
| 2271782 | 12/1975 | France | 36/50 |
| 2375841 | 7/1978 | France | 36/50 |
| 430494 | 8/1967 | Switzerland | 36/50 |

*Primary Examiner*—James Kee Chi

*Attorney, Agent, or Firm*—Nicholas J. Aquilino

[57] ABSTRACT

A shoe having an elasticized lower vamp opening in combination with an adjustable and flexible closure assembly to fasten the shoe. The elastic at the lower vamp opening permits this part of the shoe to expand as required by the flexing of the wearer's foot and to recover the tautness and tension originally available in the shoe. The closure assembly utilizes separable fastening members having complementary coacting flexible gripping elements as the fastening means, a fastener strap and an anchor means which engages the free end of the fastener strap to permit the wearer to easily adjust and maintain the closure assembly to the precise tautness desired and to fasten the shoe, using only one hand. The improvements of this combination enables the wearer to obtain the optimum custom-fit and overall foot comfort.

29 Claims, 18 Drawing Figures

ADJUSTABLE AND FLEXIBLE CLOSURE ASSEMBLY FOR SHOES WITH ELASTICIZED LOWER VAMP OPENING

REFERENCE TO RELATED APPLICATIONS

This application is a continuation-in-part of application Ser. No. 21,008 filed Mar. 16, 1979, now abandoned, for Adjustable and Flexible Closure Assembly For Shoes With Elasticized Lower Vamp Opening.

FIELD OF THE INVENTION

The present invention relates to low-cut and high-cut shoes, particularly shoes for tennis, basketball, racquetball, running, soccer, jogger and other sports. However, the improvements of this invention are adaptable to dress shoes, work shoes and other footwear.

BACKGROUND OF THE INVENTION

This invention relates to improvements in shoe construction whereby an elasticized lower vamp opening is used in combination with a multi-adjustable and flexible closure assembly to secure the shoe.

Shoes with laces easily loosen, which reduces their tautness and greatly minimizes their effectiveness. Shoes using laces as fastening means require frequent retying in order to maintain a proper fit for the most comfort. This situation is always prevalent because the constant flexing of the foot or the minimal force exerted against the laces will cause them to loosen or slacken. Shoes using buckles or similar fastening devices offer only a limited tautness to the wearer's foot because of the fixed spacing of the holes in the strap for inserting the stud of the buckle to fasten the shoe. Generally, both laces and buckles require two hands to fasten the shoe.

SUMMARY OF THE INVENTION

The improvement of the present invention provides an elasticized lower vamp opening in combination with an adjustable and flexible closure assembly which permits the wearer to quickly and easily fasten the shoe to the precise tautness desired. The closure assembly requires only one hand to fasten the shoe and eliminates the need for laces, buckles or other similar fastening devices that rely on fixed position adjustments to fasten the shoe. The closure assembly also provides considerably more supporting and bracing action to the instep, ankle and heel than with conventional shoes. The elasticized lower vamp opening offers greater expansion and recovery capability by providing a constant tension to the distal part of the foot. This improved shoe construction allows the toes, ball and waist part of the foot greater natural movement and perpetual embracing action tantamount to a built-in safeguard for the foot.

The above advantages can minimize injuries to the foot, especially if engaged in a fast action sport, such as racquetball, tennis, basketball, soccer, football and the like, where the fastening means are subjected to a constant tension. Because of the simplicity of the closure assembly of this invention, children and handicapped persons can benefit greatly since they can fasten these shoes with minimum effort and dexterity.

Specifically, shoes of the present invention utilize an elastic section or elastic straps which span the lower vamp opening to provide substantially more bracing and flexing action and to permit the shoe to respond and conform to the movements of the lower part of the foot.

The closure assembly includes separable fastening members having complementary coacting felxible gripping elements as the fastening means, a fastener strap and an anchor means to engage the fastener strap. The fastener strap has a fixed end attached to one side of the shoe and a free end. The free end of the fastener strap includes a fastening member having flexible gripping elements. A complementary fastening member has flexible gripping elements positioned adjacent the fixed portion of the fastener strap. The anchor means or anchor strap has one end formed on the opposite side of the shoe and a free end having an opening through which the free end of the fastener strap passes to secure the shoe.

Among the objects of the present invention is the provision of a shoe having a non-adjustable elasticized vamp opening and a multi-adjustable and flexible closure assembly which permits the wearer to independently control and adjust the fastening means to the precise desired tautness thereby obtaining a custom fit and more comfort to the wearer's foot.

DESCRIPTION OF THE PREFERRED EMBODIMENTS

Figure 1:
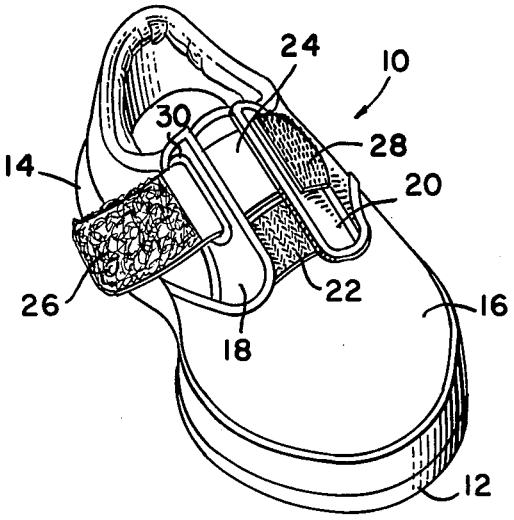
FIG. 1 is a perspective view of a first embodiment of the shoe of the present invention.
Figure 15:
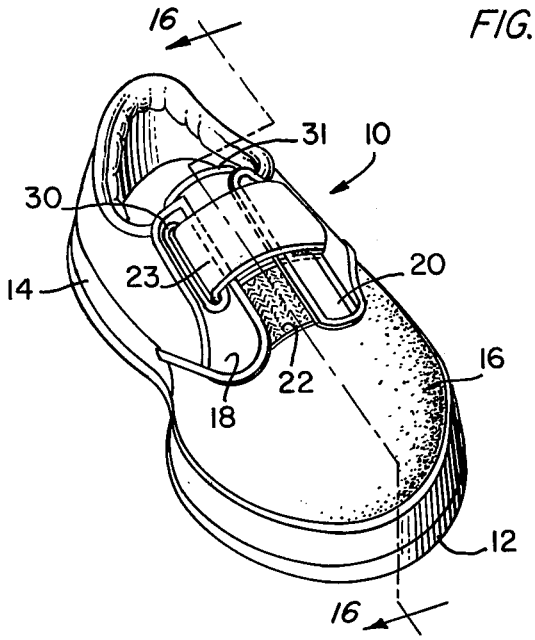
FIG. 15 is a perspective view of the shoe of FIG. 1 showing the closure assembly in the closed position.
Figure 16:
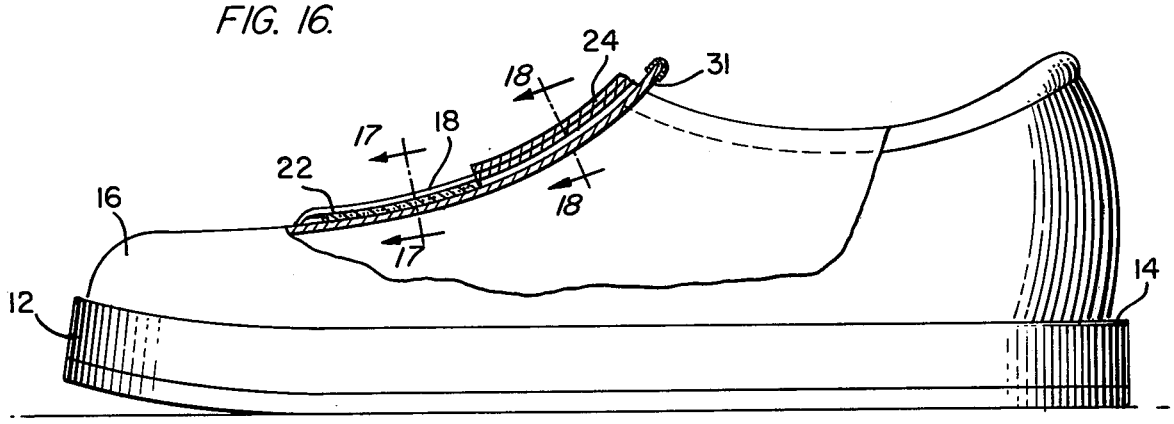
FIG. 16 is a side sectional view taken along line 16—16 of FIG. 15.
Figure 17:
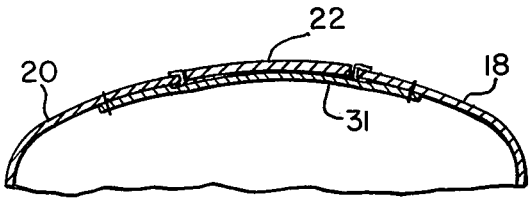
FIG. 17 is a sectional view taken along line 17—17 of FIG. 16.
Figure 18:
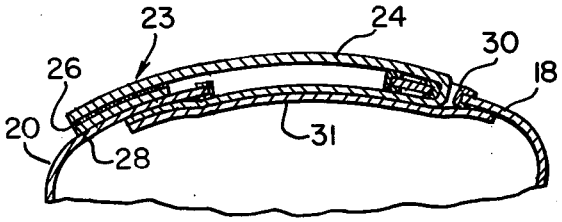
FIG. 18 is a sectional view taken along line 18—18 of FIG. 16.

FIGS. 1 and 15 illustrate a blucher-type style tennis shoe 10 embodying the adjustable and flexible closure assembly of the present invention. FIG. 1 shows the closure assembly in the open position, and FIG. 15 shows the closure assembly in the closed position. The shoe includes a sole 12, a heel 14 and uppers 16 including quarters 18 and 20. An elastic gore 22 connects the lower portion of the quarters 18 and 20 to provide a bracing and flexing action in response to the movement of the lower part of the foot of the wearer. An adjustable and flexible closure assembly 23 connects the quarters 18 and 20 above the elastic gore 22. The closure assembly includes a fastener strap 24 having a free end and a fixed end which is secured to the quarter 20. The closure assembly utilizes a flexible, multi-adjustable, separable fastener means having first and second fastening members including an array of complementary, coacting flexible gripping elements on each of the members, such as Velcro-type hook and loop fastening means. However, it will be appreciated that other similar flexible types of separable fasteners are equally applicable for use with the present closure assembly. The free end of the fastener strap 24 is provided with a pad 26 of loop-type fastening material which coacts with a separate pad 28 of hook-type fastening material secured to the quarter 20. The free end of fastener strap 24 passes through a grommet 30 which forms an opening in the quarter 18. A tongue 31 formed as part of or connected to the shoe uppers 16, underlies the elastic gore 22 and the closure assembly 23, as can be seen with reference to FIGS. 16,17 and 18 which show in detail the combination of elements which connect the quarters 18 and 20.

In use, after the fastener strap is inserted through the grommet, it is pulled through causing the quarters 18 and 20 to be simultaneously pulled inwardly until a precise desired tautness is achieved. The fastener strap 24 is then folded back and the co-acting hook and loop fastening pads 26 and 26 are pressed together to secure the closure assembly.

Figure 2:
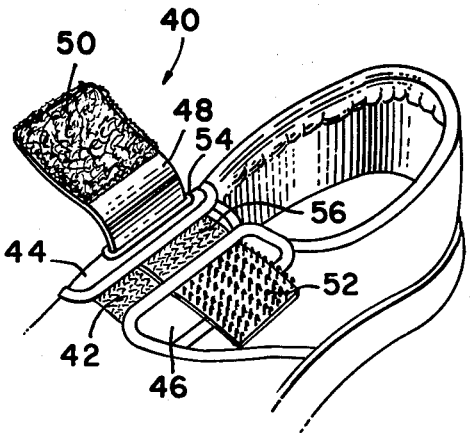
FIG. 2 is a partial perspective view of a second embodiment of the shoe of the present invention.

FIG. 2 shows a partial view of a blucher style tennis shoe 40 of the same type as disclosed in FIG. 1 including an elastic gore 42 which connects quarters 44 and 46 and an adjustable and flexible closure assembly including a fastener strap 48 utilizing a Velcro-type hook and loop fastening means including a pad 50 of hook fastening material on the free end of the fastener strap 48 and a pad 52 of loop material on the quarter 46. A grommet 54 provides an anchor means for the fastener strap 48. The fastener strap further includes a section of elastic 56 at its fixed end and secured under the quarter 40 which provides greater flexibility.

Figure 3:
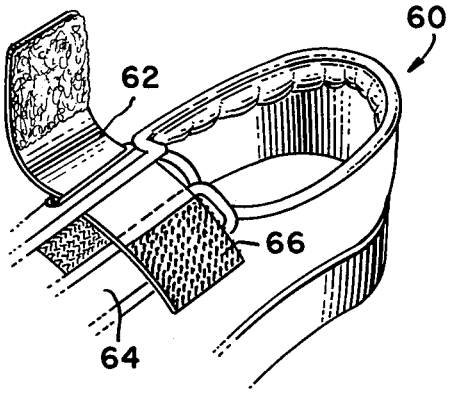
FIG. 3 is a partial perspective view of a third embodiment of the shoe of the present invention.

FIG. 3 illustrates a blucher style tennis shoe 60 which is also the same type as described in FIG. 1 with the exception of the construction of the fastener strap 62 which is attached over the quarter 64 and includes a pad 66 of hook fastener material attached adjacent to the fixed portion of the fastener strap 62. The remainder of the shoe structure and the use thereof is essentially the same as the embodiment shown in FIG. 1.

Figure 4:
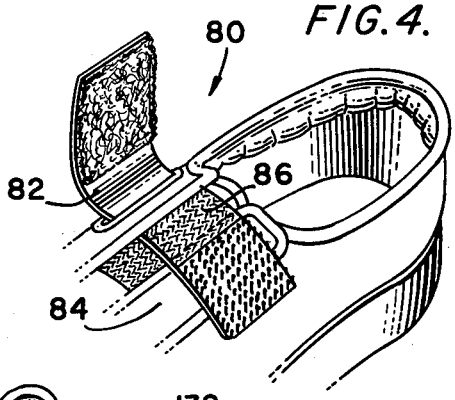
FIG. 4 is a partial perspective view of a fourth embodiment of the shoe of the present invention.

FIG. 4 shows a partial view of a blucher style tennis shoe 80 which is essentially the same as the shoe shown in FIG. 3 and includes a fastener strap 82 attached over the quarter 84 and differs in the inclusion of an elastic section 86 in the strap 82 providing a greater flexibility.

Figure 5:
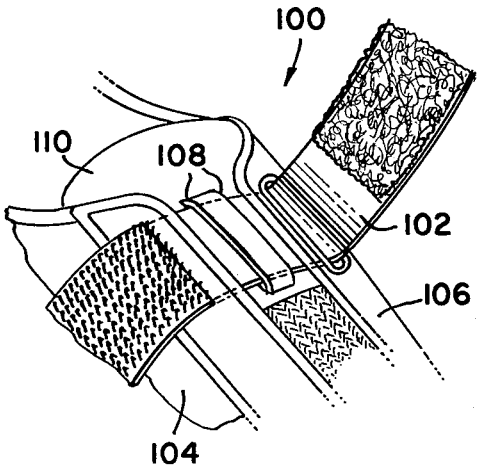
FIG. 5 is a partial perspective view of a fifth embodiment of the shoe of the present invention.

FIG. 5 shows another partial view of a blucher style tennis shoe 100 including a fastener strap 102 connected between quarters 104 and 106 which passes through slits 108 in the tongue 110.

Figure 6:
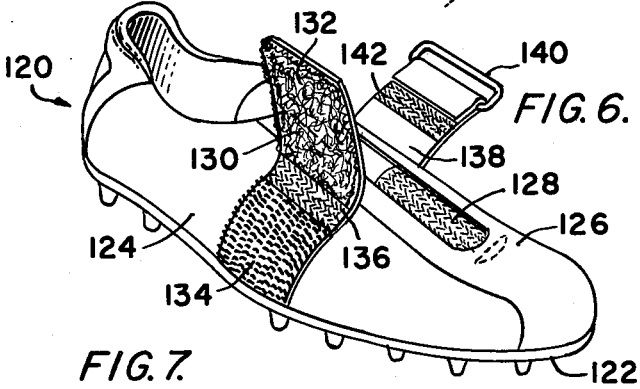
FIG. 6 is a perspective view of a sixth embodiment of the shoe of the present invention.

FIG. 6 illustrates a soccer style shoe 120 having a sole 122 and uppers 124 with a U-throat vamp 126, the lower portion of which includes an elastic gore 128. The shoe is provided with an adjustable and flexible closure assembly having a fastener strap 130 which utilizes a Velcro-type hook and loop fastening means including a pad 132 of loop fastening material at the free end and a pad 134 of hook fastening material at its fixed end. An elastic section 136 on the fastener strap 130 between the pads 132 and 134 increases the flexibility of the fastener strap. An anchor strap 138 includes a D-ring 140 attached to its free end which forms an opening through which the fastener strap 130 passes to secure the closure assembly. The anchor strap 138 further includes an elastic section 142 to provide increased flexibility.

Figure 7:
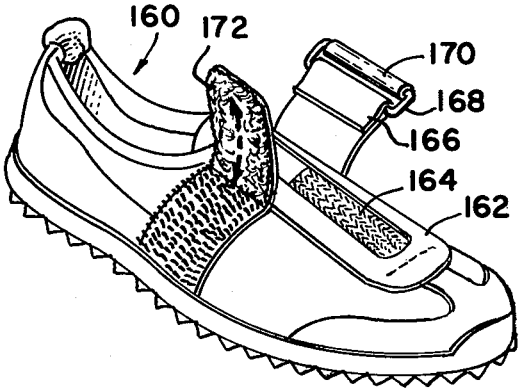
FIG. 7 is a perspective view of a seventh embodiment of the shoe of the present invention.

FIG. 7 illustrates a running shoe 160 having a U-throat vamp 162, the lower portion of which includes an elastic gore 164. The shoe is provided with an adjustable and flexible closure assembly including an anchor strap 166 having a D-ring 168 with a roll bar 170 and a fastener strap 172 utilizing elasticized Velcro-type material forming a hook and loop fastening means.

Figure 8:
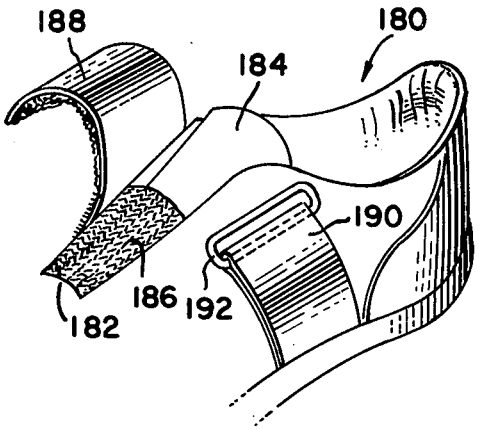
FIG. 8 is a partial perspective view of an eighth embodiment of the shoe of the present invention.

FIG. 8 shows a partial view of a running shoe 180 having a V-shaped vamp opening 182 and tongue 184, the lower portion of which is provided with an elastic gore 186 overlaying tongue 184. The shoe is also provided with an adjustable and flexible closure assembly including a fastener strap 188 which spans the opening 182, and over the tongue 184 to engage an anchor strap 190 having a D-ring 192. The fastener strap 188 utilizes a Velcro-type hook and loop fastening means (partially shown) and is secured in the same general manner as described hereinabove with reference to the other embodiments.

Figure 9:
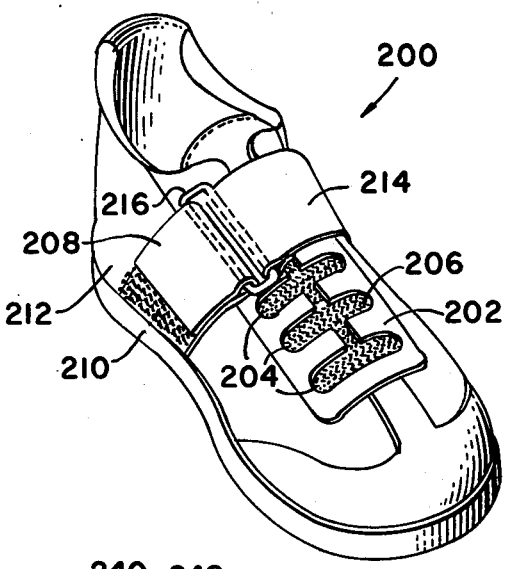
FIG. 9 is a perspective view of a ninth embodiment of the shoe of the present invention.

FIG. 9 shows a running shoe 200 having a U-throat vamp 202 which includes slots 204. A section of elastic 206 underlines the lower portion of the U-throat vamp 202. The shoe is provided with an adjustable and flexible closure assembly including a fastener strap 208, the fixed end of which is attached where the sole 210 and the shoe uppers 212 adjoin. An anchor strap 214 having a D-ring 216 engages the free end of fastener strap 208 which utilizes a hook and loop Velcro-type fastening means to secure the closure assembly.

Figure 10:
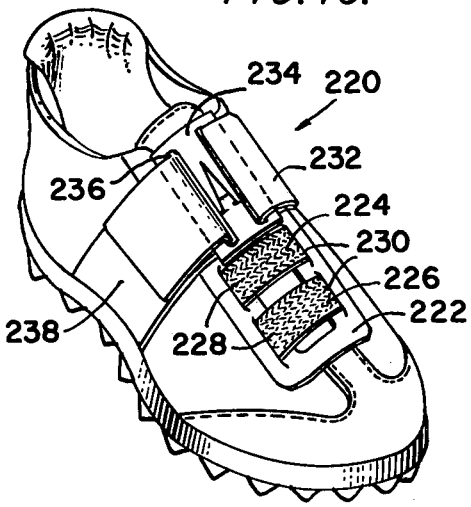
FIG. 10 is a perspective view of a tenth embodiment of the shoe of the present invention.

FIG. 10 shows a running show 220 including a U-throat vamp 222 with two elastic straps 224 and 226 inserted in slots 228 and 230 in the U-throat vamp 222. The shoe is provided with an adjustable and flexible closure assembly including an anchor strap 232, the free end of which is provided with a connector plate 234 having an opening 236 through which the free end of the fastener strap 238 is passed to secure the assembly. The fastener strap 238 utilizes a Velcro-type hook and loop fastening means and is shown in secured position.

Figure 11:
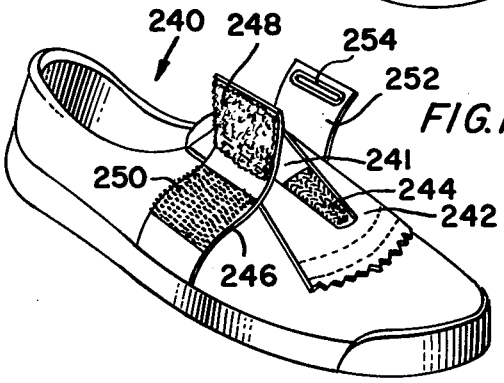
FIG. 11 is a perspective view of an eleventh embodiment of the shoe of the present invention.

FIG. 11 shows a deck or tennis-type shoe 240 having a V-throat vamp opening 241 provided with a shawl or apron-type member 242 including an elastic gore 244. The shoe 240 utilizes an adjustable and flexible closure assembly including fastener strap 246 having spaced Velcro-type hook and loop fastening means formed of a pad 248 of loop fastening material and a pad 250 of hook fastening material. An anchor strap 252 includes a grommet 254 in its free end adapted to receive the free end of fastener strapstrap 246 to secure the closure assembly.

Figure 12:
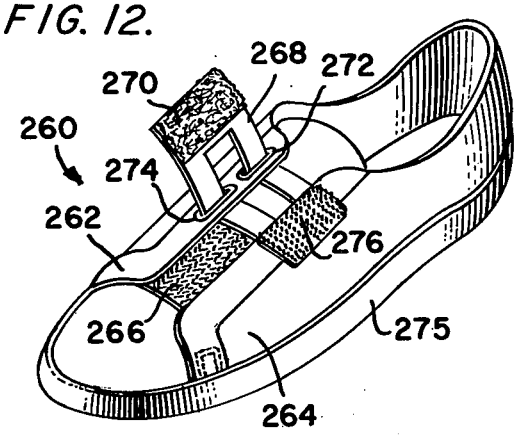
FIG. 12 is a perspective view of a twelfth embodiment of the shoe of the present invention.

FIG. 12 shows a blucher-type basketball shoe 260 including quarters 262 and 264, the lower end of which are connected by an elastic gore 266. The shoe 260 is provided with an adjustable and flexible closure assemlby utilizing a bifurcated fastener strap 268 forming leg members connected to the portion including a pad 270 of loop fastening material secured adjacent its free end. Each of the leg members of the bifurcated fastener strap 268 pass through and are retained by grommets 272 and 274, respectively, in the quarter 262 and having their fixed ends attached to the opposite quarter 264. A separate pad 276 of hook fastening material is attached to the quarter 264 above the sole 275 and coacts with the pad 270 of loop-type material when the closure assembly is secured.

Figure 13:
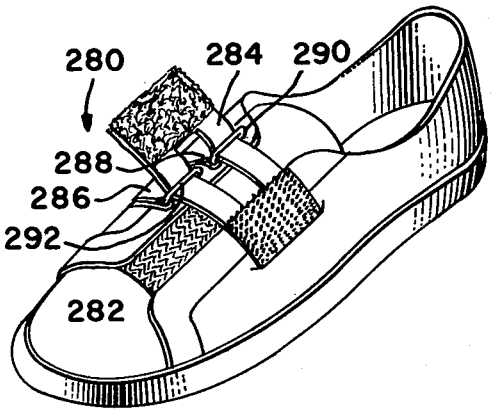
FIG. 13 is a perspective view of a thirteenth embodiment of the shoe of the present invention.

FIG. 13 shows a blucher style basketball shoe 280 of the same type as shown in FIG. 12 provided with an elastic gore 282 and an adjustable and flexible closure assembly including a bifurcated fastener strap 284 which utilizes hook and loop fastening means. The shoe utilizes anchor straps 286 and 288, each of which are provided with D-rings 290 and 292, respectively, to retain each of the members of the bifurcated strap 284. The closure assembly is secured in the same manner as described in FIG. 12.

Figure 14:
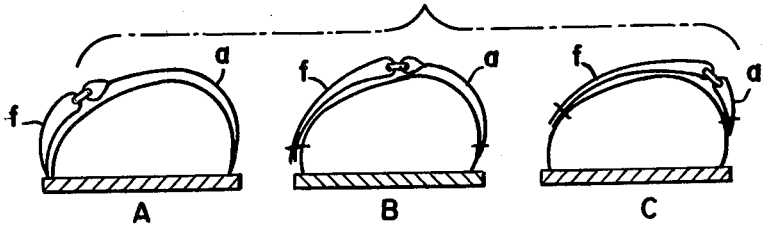
FIG. 14 is a side sectional view of the shoe of the present invention showing the straps of the closure assembly in various positions.

FIG. 14 illustrates various arrangements where the fixed ends of the fastener and anchor straps are secured to the shoe and the location where the free ends of the straps engage to fasten. FIG. 14*a* shows a fastener strap f, the fixed end of which is secured at the junction of the sole of the shoe and the shoe upper and which does not extend pass the side of the shoe to which it is secured. The anchor strap a is also secured at the junction of the sole and the shoe upper on the other side of the shoe and extends over the shoe to the side where the fastener strap is located to secure the closure assembly. FIG. 14*b* illustrates an arrangement where the fastener strap f is attached above the sole of the shoe and extends partially over the shoe. The anchor strap a is also attached above the sole of the shoe and extends partially over the shoe to engage the fastener strap. FIG. 14*c* illustrates a closure arrangement wherein a fastener strap f is secured above the sole and extends over the shoe to the opposite side. An anchor strap a is secured above the shoe sole but remains on that side of the shoe to engage the fastener strap.

These various arrangements in length and location of both the fastener strap and the anchor strap are interchangeable and may be used on any of the embodiments shown in this application as long as the arrangement is consistent with that particular style of shoe. As shown in FIGS. 14*b* and 14*c*, the strap may be secured at a point relatively near the sole of the shoe, FIG. 14*b*, or at a point well up on the shoe uppers, FIG. 14*c*.

It will be appreciated that various modifications may be made in the present invention. For example, various types of separable fastening means are interchangeable with the closure assembly of the present invention. The invention works equally well whether the anchor opening is a D-ring, grommet or plate. The features described above are also readily interchangeable on the various embodiments of the shoes presented herein.

What is claimed is:

1. In a shoe having a sole, tongue and uppers, including a vamp and quarters and a vamp opening in said shoe, said vamp opening having an upper portion and a lower portion, said lower portion of said opening including elasticized material connecting said quarters and spanning said opening and overlying said tongue, said upper portion of said opening including an adjustable and flexible closure assembly connecting said quarters and spanning said opening and overlying said tongue, said closure assembly located adjacent and substantially above said elasticized material connecting said quarters, said tongue providing a first layer between said quarters, said elasticized material and said closure assembly providing a second layer between said quarters, said closure assembly comprising:

a flexible, multi-adjustable, separable fastener means having first and second fastening members including arrays of complementary, coacting flexible gripping elements for securing said closure assembly;

a fastener strap having a fixed portion and a free end, said free end including said fastening member, said second fastening member positioned adjacent said fixed portion of said fastener strap; and anchor means including an anchor opening through which said free end of said fastener strap passes permitting adjustment to maintain a precise desired tautness of said closure assembly to fasten said shoe.

2. The shoe of claim 1 wherein said arrays of complementary, coacting flexible gripping elements include an array of hook type gripping elements on said first fastening member and an array of loop type gripping elements on said second fastening member.

3. The shoe of claim 1 wherein said opening in said anchor means is formed by a D-ring.

4. The shoe of claim 1 wherein said opening in said anchor means is formed by a grommet.

5. The shoe of claim 1 wherein said opening in said anchor means is formed by a connector plate.

6. The shoe of claim 1 wherein said fastener strap includes a section of elastic.

7. The shoe of claim 1 wherein said anchor means defines an anchor strap.

8. The shoe of claim 7 wherein said anchor means includes a section of elastic.

9. The shoe of claim 1 wherein said fastener strap includes a second coacting member of flexible gripping elements.

10. The shoe of claim 1 wherein a second coacting member of flexible gripping elements is provided on said uppers separate from said fastener strap.

11. The shoe of claim 1 wherein said uppers further include quarters and said anchor opening is formed by a grommet in one of said quarters.

12. The shoe of claim 1 further including a tongue underlying said vamp opening, said tongue including a loop for positioning said fastener strap.

13. The shoe of claim 1 wherein said elasticized material is formed of a single member spanning said vamp opening.

14. The shoe of claim 1 wherein said elasticized material is formed of a plurality of members spanning said vamp opening.

15. The shoe of claim 3 wherein said D-ring includes a roll bar.

16. The shoe of claim 1 wherein said first and second fastening members are formed of elasticized material.

17. The shoe of claim 1 wherein said vamp is a U-throat type and said vamp opening is defined by a series of slots spanned by said elasticized material.

18. The shoe of claim 1 wherein said vamp is V-shaped and said shoe further includes a tongue underlying said vamp opening.

19. The shoe of claim 1 wherein said elasticized material defines a gore.

20. The shoe of claim 1 wherein said fastener strap is bifurcated forming leg members fixed to one side of the shoe and a portion connecting said leg members permanently retained in said anchor means on the opposite side of said shoe.

21. The shoe of claim 20 wherein said portion of said bifurcated fastener strap is free and includes a pad of hook and loop fastening material.

22. The shoe of claim 21 further including a separate pad of hook and loop fastening material which coacts with said pad on said bifurcated fastener strap.

23. The shoe of claim 7 wherein said fastener strap crosses said shoe to engage said anchor strap on the opposite side of said shoe.

24. The shoe of claim 7 wherein said anchor strap crosses said shoe to engage said fastener strap on the opposite side of said shoe.

25. The shoe of claim 7 wherein said fastener strap and said anchor strap extend to engage between said shoe quarters.

26. The shoe of claim 1 wherein said fixed portion of said fastener strap is connected at the point where said sole and uppers join.

27. The shoe of claim 1 wherein said fixed portion of said fastener strap is connected to said uppers above said sole.

28. The shoe of claim 1 wherein said anchor means is connected at the point where said sole and said uppers join.

29. The shoe of claim 1 wherein said anchor means is connected to said uppers above said sole.

* * * * *